United States Patent [19]

Jones et al.

[11] Patent Number: 4,648,804

[45] Date of Patent: Mar. 10, 1987

[54] ASPIRATOR PUMP DEVICE FOR USE IN SEMICONDUCTOR PROCESSING

[75] Inventors: Mark Jones; George Letrich, both of Mesa, Ariz.

[73] Assignee: Intel Corporation, Santa Clara, Calif.

[21] Appl. No.: 781,234

[22] Filed: Sep. 27, 1985

[51] Int. Cl.[4] ..... F04B 23/14; C23C 14/00

[52] U.S. Cl. ..... 417/87; 118/50

[58] Field of Search ..... 417/85, 87, 54, 151, 417/152; 118/50

[56] References Cited

U.S. PATENT DOCUMENTS

| | | | |
|---|---|---|---|
| 2,636,655 | 4/1953 | McFee | 417/87 X |
| 3,095,494 | 6/1963 | Denton et al. | 118/715 X |
| 3,480,200 | 11/1969 | Rohrer | 417/85 |
| 3,556,681 | 1/1971 | Jennings | 417/87 |
| 4,214,853 | 7/1980 | Mahl | 417/154 |
| 4,361,418 | 11/1982 | Tscheppe | 417/152 X |

FOREIGN PATENT DOCUMENTS

| | | | |
|---|---|---|---|
| 2732696 | 2/1979 | Fed. Rep. of Germany | 417/85 |
| 104590 | 8/1980 | Japan | 417/152 |

*Primary Examiner*—Carlton R. Croyle
*Assistant Examiner*—Paul F. Neils
*Attorney, Agent, or Firm*—Blakely, Sokoloff, Taylor & Zafman

[57] ABSTRACT

An evacuation system for removing corrosive gas from a process tube during processing of semiconductor wafers. An aspirator is used for an initial pump down of the process tube to approximately 200 TORR. The aspirator has no moving parts and does not react to the corrosive gas. The aspirator is controlled by a control circuit which utilizes a series of relays to open a ball valve and start the aspirator. After 200 TORR is reached, the aspirator is shut off, the ball valve is closed and a high vacuum pump is utilized to complete the evacuation. Because the vacuum pump is exposed to a reduced volume of corrosive gas, its lifetime is correspondingly increased.

5 Claims, 4 Drawing Figures

ASPIRATOR PUMP DEVICE FOR USE IN SEMICONDUCTOR PROCESSING

BACKGROUND OF THE INVENTION

1. Field of the Invention

The present invention relates to the field of evacuation systems used in semiconductor water processing. More specifically, the present invention relates to a method of evacuating HF gas from a process tube.

2. Prior Art

During processing of semiconductor wafers, they are sometimes places on sleds, and processed through a deposition step. These sleds require regular cleaning to remove the material that has been deposited on them. The sleds are placed in a process tube, and exposed to hydrogen fluoride (HF) gas. After the cleaning, it is desired to remove the gas from the process tube. Typically this is done by evacuating the process tube which contains the gas and the sleds. In the prior art this evacuation was done with a vacuum pump having a slow pump line and a high vacuum line. The slow pump line was first utilized to reduce the pressure in the tube to a first threshold level (for example, 200 TORR). Then the high vacuum valve is opened, and the tube is pumped down to a base pressure.

A disadvantage of the old method is the short lifetime of the vacuum pump. Because of the highly corrosive nature of the gas, the vacuum pump fails after a relatively short period of use.

Therefore, it is an object of the present invention to provide a method of evacuating corrosive gas from a process tube which results in a longer lifetime for vacuum pumps than prior art methods.

It is a further object of the present invention to provide a control system for automatically controlling the evacuation system.

SUMMARY OF THE PRESENT INVENTION

The present invention utilizes an aspirator pump to evacuate the process tube to a first threshold pressure level. The aspirator has no moving parts and is constructed of material that resists corrosion by the processed gas. After the threshold level is reached, a control circuit shuts off the aspirator and opens a valve between the tube and a vacuum pump, which continues pumping down the process tube until a base pressure is reached. Because there is less corrosive gas in the process tube when the high vacuum pump is activated, the corrosive action of the gas on the vacuum pump is reduced and the lifetime of the pump is increased. Two ball valves are utilized to switch between the aspirator and pump systems and the entire system is electronically controlled.

DETAILED DESCRIPTION OF THE PRESENT INVENTION

An evacuation system utilizing an aspirator pump for initial evacuation and a high vacuum pump for further evacuation is described. In the following description, numerous specific details are set forth such as control voltages, pump rates, etc. in order to provide a thorough understanding of the present invention. It will be obvious, however, to one skilled in the art that the present invention may be practiced without these specific details. In other instances, well-known structures have not been shown in detail in order not to unnecessarily obscure the present invention.

As part of their processing, semiconductor wafers are placed on sleds in a process tube for various modification steps. These sleds require regular cleaning, and are placed in a process tube and exposed to HF gas, which removes contaminants from the sled surface. After the step in which this gas is used, it is desired to purge the tube of the gas. In the prior art this is accomplished by a two-step process. Initially, the tube undergoes a slow evacuation by a vacuum pump. Then, after a certain pressure is reached, a high evacuation by the vacuum pump removes the remainder of the HF gas and reduces the pressure in the tube to a base pressure. A disadvantage of this method is the exposure of the vacuum pump to a large amount of HF gas. The HF gas is highly corrosive. Due to the exposure, the lifetime of the vacuum pump is very short. Typically, only 50 runs (pump-downs) can be done before pump failure.

The present invention also utilizes a two-stage evacuation process. However, the first stage utilizes an aspirator to evacuate the tube to a first pressure, (in the preferred embodiment 200 TORR), and then utilizes a vacuum pump for a high evacuation to the base pressure, typically 20 m TORR. The problem of low pump lifetime is thereby reduced by use of the aspirator. The aspirator has no moving parts and is formed of a material which is not reactive with the process gas. As a result, the vacuum pump is exposed to much less gas than prior art vacuum pumps and correspondingly has a longer lifetime. Up to 800 runs have been achieved with a single vacuum pump using this system.

Figure 3:
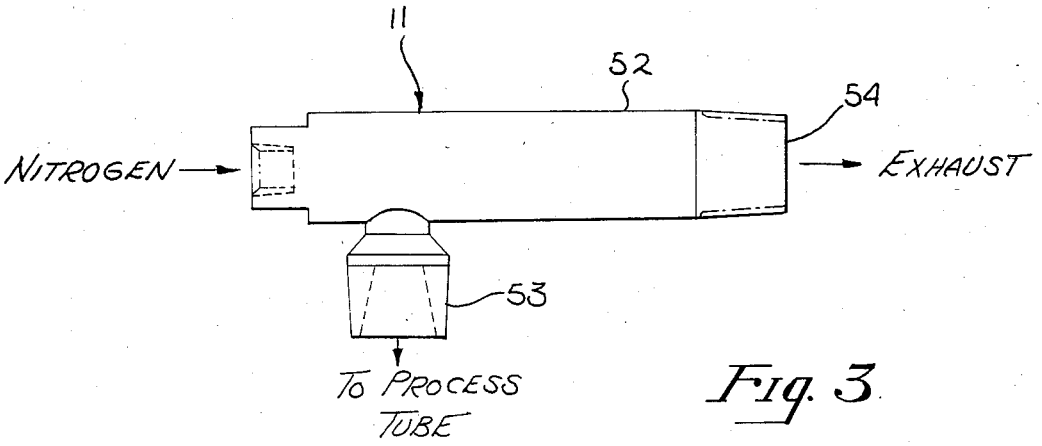
FIG. 3 is a plan view illustrating the aspirator pump of the present invention.

The aspirator of the present invention is illustrated in FIG. 3. The aspirator pump consists of a hollow tube 52 and hollow member 53 extending generally perpendicularly from tube 52. To activate the aspirator 11, a motive gas is pumped through tube 52 and out the exhaust. In the presently preferred embodiment, the motive gas is nitrogen. The flow of nitrogen through tube 52 reduces the pressure in tube 52 below that within extension 53. Gas at high pressure tends to flow to areas of low pressure. Thus, the gas in extension 53 is drawn into tube 52 and to the exhaust. Extension 53 is connected, through ball valve 56, to the process tube. Thus, the gas in the process tube is drawn out by the action of the aspirator. In the presently preferred embodiment, the nitrogen gas is introduced to the aspirator 11 at a rate of 23 SCFM. While the aspirator is operating, nitrogen is introduced to the process tube to aid in flushing the HF gas from the tube, or purging the tube.

Figure 1:
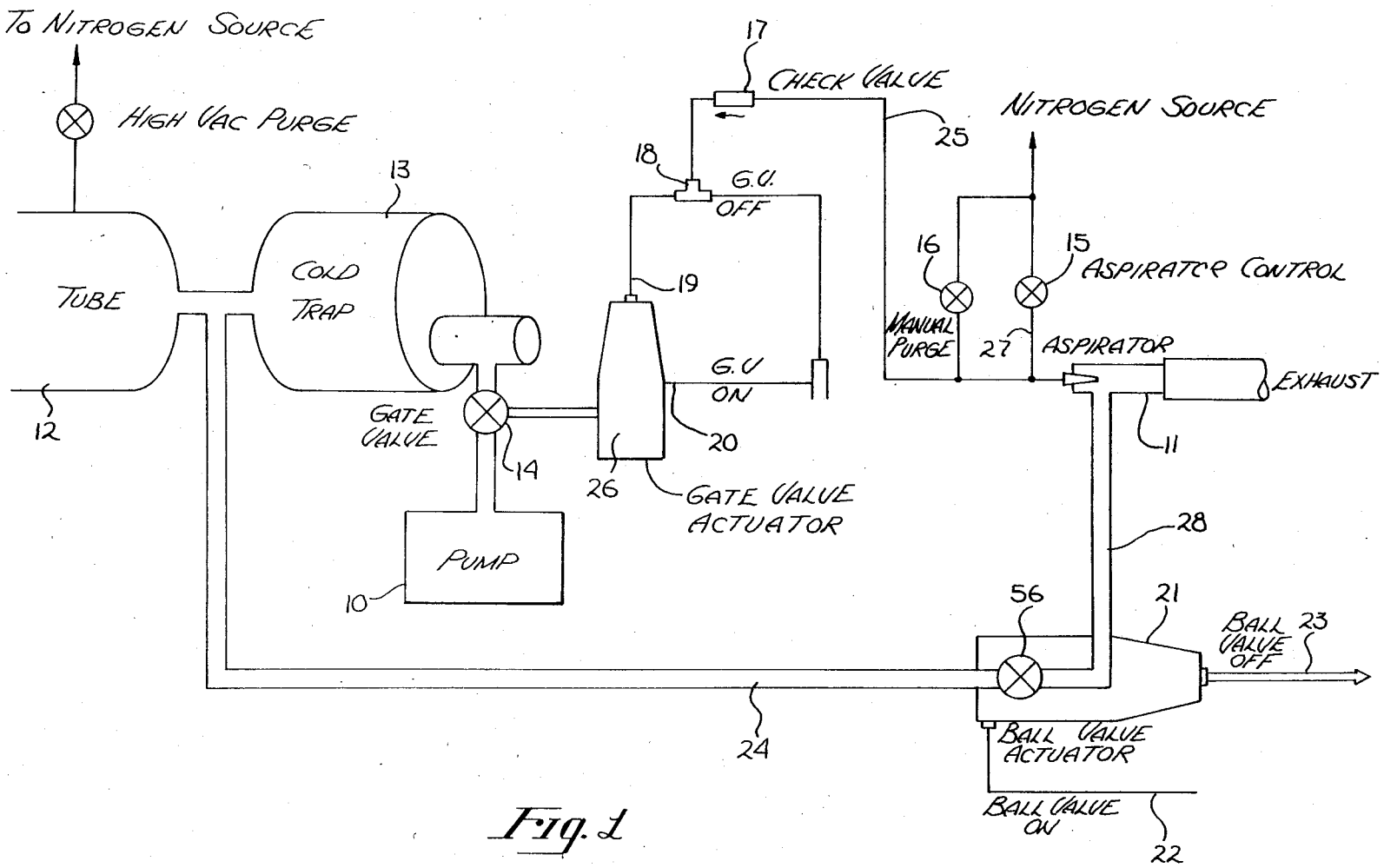
FIG. 1 illustrates the preferred embodiment of the present invention.

The preferred embodiment of the evacuation system of the present invention is illustrated in FIG. 1. The process tube 12 contains the corrosive gas. A vacuum pump 10 is coupled to the tube through a gate valve 14 and a cold trap 13. Vacuum pump 10 may be any suitable pump for pumping to low pressures, such as for example, a diffusion pump, mechanical piston pump, ect. The gate valve 14 is used to isolate the vacuum pump during the initial pump-down, which is performed by the aspirator 11. The cold trap 13 is used to condense and trap particulates contained in the HF gas.

Figure 4:
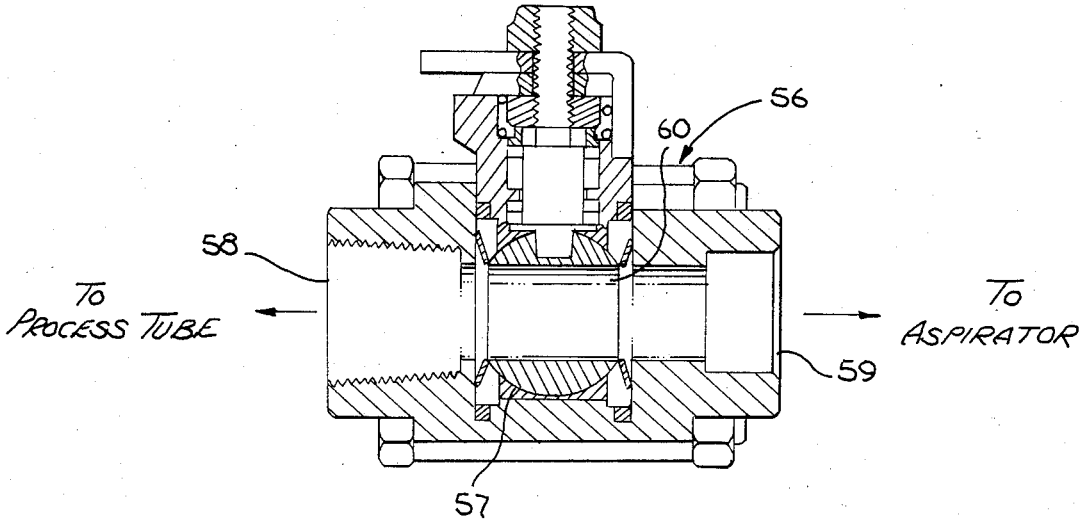
FIG. 4 is a cross-sectional view of a ball valve of the present invention.

The aspirator 11 is coupled to the process tube through line 24. A ball valve actuator 21 controls a ball valve 56 which is inserted between the aspirator and the process tube and is used to isolate the aspirator during the second stage of the pump down, which is performed by the vacuum pump 10. Ball valve 56 is illustrated in FIG. 4. Ball valve 56 includes a ball 57 having an axial opening 60 therethrough. This opening provides a path between the process tube via coupling 58 and the aspirator via coupling 59. When the ball 57 is rotated so that the axial opening 60 no longer accesses either coupling, the ball valve is off, and no fluid is transported.

A nitrogen source 55 is coupled to the aspirator 11 through line 25. As previously mentioned, nitrogen is used as the motive for aspirator pump 11. The flow of nitrogen to line 25 and therefore the aspirator 11 is controlled by two valves, manual purge valve 16 and aspirator control valve 15. Aspirator control valve 15 is a normally closed valve which is activated by the control unit (discussed in detail below). Manual purge valve 16 is a manually operated valve which releases a low pressure of nitrogen to the aspirator when opened. Valve 16 is left on even when the aspirator is not in operation in order to continuously purge the aspirator 11.

Line 25 is also connected to the gate valve actuator 26. Gate valve actuator 26 is used to control gate valve 14, which provides access between the process tube and the vacuum pump.

During initial pump-down of the process tube, the ball valve 56 is turned on (open). The ball valve actuator may be a spring return or double acting model. The actuator switches the ball valve from one position to another. In this application, actuator 21 holds the ball valve on (open) during operation of the aspirator 11 and off (closed) during operation of the vacuum pump. The actuator is essentially a two state device. The state of the actuator can be set by the flow of nitrogen gas to the ball-valve-on line 22 and the ball-valve-off line 23. The ball valve actuator is coupled to the nitrogen source 55.

A second actuator, gate valve actuator 26, is used to control the gate valve 14 between the cold trap 13 and vacuum pump 10. Gate valve actuator 26 is also a two state device, identical to actuator 21. The gate valve off line 19 is coupled to the nitrogen source of the aspirator through "tee" 18 and check valve 17. When the aspirator is operating, nitrogen travels through line 25 to check valve 17. Check valve 17 is a one way valve which will open if sufficent differential pressure exists. In the preferred embodiment, check valve 17 is a 1 psi valve. The nitrogen passes through check valve 17, tee 18 and through the gate valve off line 19 of gate valve actuator 26. As a result, even though gate valve on line 20 is pressurized during operation of the aspirator. Gate valve 14 is held in its normally off (closed) state. When the aspirator is no longer in operation, the aspirator control valve 15 is closed, the nitrogen pressure in line 25 falls below 1 psi, check valve 17 closes, no nitrogen is supplied to gate valve off line 19, and the gate valve on line 20 is allowed to turn on actuator 26, opening gate valve 14.

At this stage, the vacuum pump is allowed to complete the evacuation of the process tube 12 to a base pressure, which in the preferred embodiment is 20 milli TORR. During the entire operation, the manual purge valve 16 of the aspirator 11 should be left on for a constant purge of the aspirator 11.

Figure 2:
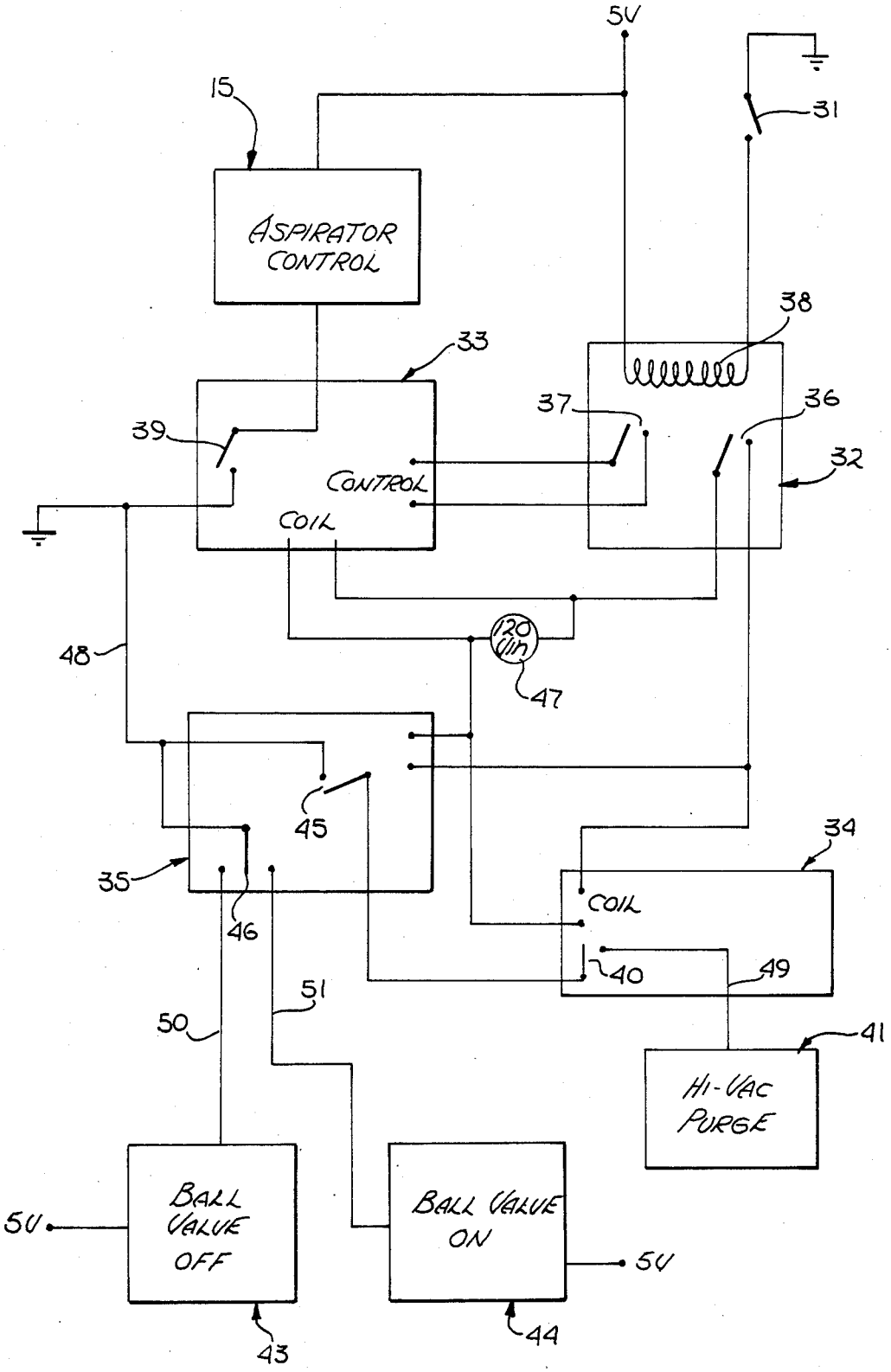
FIG. 2 is a block diagram illustrating the control circuit of the present invention.

The control unit is shown in detail in FIG. 2. Relay 32 is a miniature 5 volt relay. The relay 32 is connected to a 5 volt voltage source and a ground through coil 38. A switch 31 in the ground line is utilized as a "soft start switch". When this switch 31 is closed a ground is supplied to the 5 volt voltage and the switches 36 and 37 of relay 32 are closed. Switch 36 completes a circuit which provides 120 volts AC current supply to relays 33, 34 and 35. Switch 37, when closed, connects the control pins of relay 33 together. This activates switch 39 of relay 33 which is coupled on one end to ground and on the other end to the aspirator control 15. The aspirator control 15 is also coupled to the 5 volt voltage supply and is turned on once the ground is supplied through switch 39 of relay 33. This then opens the line 27, allowing nitrogen to pass through the aspirator 11, activating it.

Relay 35 contains switches 45 and 46. Both switches are coupled to the ground through line 48. Switch 46, during operation of the aspirator, is coupled to line 51. Line 51 connects to the ball valve on control 44 which is also coupled to the 5 volt voltage supply. Switch 46 provides a ground, and the ball valve on control is activated. When ball valve on control 44 is activated, nitrogen is supplied to the ball valve on line 22 of FIG. 1, causing the ball valve actuator 21 to open the ball valve. This opens line 24 between the process tube 12 and aspirator 11.

Relay 34 contains switch 40 and line 49. High vac purge 41 is coupled through line 49 to switch 40. Switch 40 is coupled to switch 45 of relay 35 which in turn is coupled to the ground through line 48. When these relays are energized switches 45 and 40 are closed providing ground to the high vac purge 41. High vac purge 41 provides nitrogen to the process tube 12, aiding in the removal of HF gas.

When the soft start switch is opened, and ground is removed from relay 32, relay 33, 34 and 35 are also deenergized. Switch 46 of relay 35 is then coupled to line 51 which leads to the ball valve off control 44. The ball valve off control 43 is also coupled to the 5 volt supply and a ground is provided through switch 46 to line 48 which leads to ground. When the ball valve off is activated, nitrogen is supplied to the ball valve off line 23 of FIG. 1, causing the ball valve actuator 21 to close the ball valve. Therefore, the line 24 between the aspirator and the process tube is closed off. At this point, the nitrogen being provided to the gate valve off 19 is removed, the gate valve of FIG. 1 is opened, allowing vacuum pump 10 to evacuate the process tube to a base pressure. The timing of the control circuit must follow certain guidelines. For example, the aspirator must be activated prior to the ball valve being opened. This enables a vacuum to be created in line 28 between the ball valve and the aspirator. Then, when the ball valve is opened, more efficient evacuation of the process tube 12 takes place. The high vac purge must also be delayed until the ball valve is opened, since prior to that it will have no useful effect.

When 200 TORR is reached, the high vac purge and ball valve on are deenergized. Ball valve off is activated and the aspirator continues operating for a short period of time, (approximately 30 seconds) to fully evacuate line 28.

Thus, an evacuation system has been described which is particularly useful in conjunction with the cleaning of sleds used in semiconductor wafer processing. By performing an initial evacuation step of a process tube filled with corrosive gas, prior to using a vacuum pump to complete the evacuation, the lifetime of the pump can be greatly increased. This is due to the reduced exposure to corrosive gas by the vacuum pump.

We claim:

1. In the processing of semiconductor wafers, a device for evacuating a volume of corrosive gas contained in a processing enclosure, said device comprising:

an aspirator coupled to said enclosure and to a motive gas source, said aspirator for evacuating said enclosure to a first pressure, said aspirator having a motive fluid inlet, a nozzle, an entrained fluid inlet and an outlet;

a first valve means coupled to said motive gas source for controlling the operation of said aspirator;

a vacuum pump coupled to said enclosure for evacuating said enclosure to a second pressure, said second pressure less than said first pressure;

a second valve means coupled to said enclosure and said vacuum pump for isolating said vacuum pump during operation of said aspirator;

a third valve means coupled to said aspirator and said enclosure for isolating said aspirator during operation of said vacuum pump;

control means coupled to said valve for controlling the opening and closing of said valves;

whereby said vacuum pump is exposed to an amount of said corrosive gas less than said volume of corrosive gas, thereby extending the lifetime of said vacuum pump.

2. The device as described by claim 1 wherein said valve means are ball valves.

3. The device as described by claim 1, wherein said control means comprises a first relay having a first and second switch, said first switch coupled to a current source for providing current to second, third and fourth relays, said second switch coupled to said fourth relay, said first relay further including a coil, one end of said coil coupled to a voltage source and the other end of said coil coupled through a third switch to ground;

said second relay including a fourth switch coupled to ground and to said first valve means, said first valve means coupled to said voltage source, said first valve means coupled to said gas source and releasing said gas to said aspirator when said fourth switch is closed;

said third relay including fifth and sixth switches, said fifth switch coupled to ground and to said fourth relay, said sixth switch coupled to said third valve means and to ground;

said third valve means coupled to said voltage source, said third valve means providing an open path between said enclosure and said aspirator when said sixth switch is closed;

said fourth relay means including a seventh switch, said seventh switch coupled to said motive gas source, said motive gas source coupled to said enclosure, said motive gas source providing gas to said enclosure when said seventh switch is closed.

4. The device as described by claim 1 wherein said motive gas is nitrogen.

5. The device as described by claim 1 wherein said second valve means is coupled to said motive gas source and is closed as a result of pressure from said motive gas source when said first valve is open.

* * * * *